US005117229A

United States Patent [19]

Niioka

[11] Patent Number: 5,117,229

[45] Date of Patent: May 26, 1992

[54] ELECTROMAGNETIC WAVE ABSORBER

[75] Inventor: Yoshio Niioka, 40, Oaza-kunotsuboyama, Nishiharu-cho, Nishikasugai-gun, Japan

[73] Assignees: Yoshio Niioka, Aichi, Japan; Marvin Gottlieb, Ill.

[21] Appl. No.: 598,915

[22] Filed: Oct. 15, 1990

[30] Foreign Application Priority Data

Oct. 15, 1989 [JP] Japan ..... 1-267463

[51] Int. Cl.[5] ..... H01Q 17/00

[52] U.S. Cl. ..... 342/1; 342/4

[58] Field of Search ..... 342/1, 4

[56] References Cited

U.S. PATENT DOCUMENTS

| | | | |
|---|---|---|---|
| 2,527,918 | 10/1950 | Collard | 342/1 |
| 2,985,880 | 5/1961 | McMillan | 342/1 |
| 3,348,224 | 10/1967 | McMillan | 342/1 |
| 3,441,933 | 4/1969 | Tuinila et al. | 342/1 |
| 3,453,620 | 7/1969 | Fleming et al. | 342/1 |

*Primary Examiner*—Mark Hellner
*Attorney, Agent, or Firm*—Koda and Androlia

[57] ABSTRACT

What is disclosed is a wave absorber comprising an electromagnetic wave absorbing framework having a plurality of cells arranged to define arbitrary shape of U-shaped hollow spaces adapted to the wavelength of the electromagnetic wave to be absorbed, which is prepared by introducing bubbles into an inorganic fluid material, followed by solidification, and an electromagnetic wave absorbing ferrite material applied at least on the walls of the cells defining said U-shaped hollow spaces; wherein the main body of the electromagnetic absorber may have on the surface a weathering-resistant electromagnetic wave transmitting panel comprising a composite of ceramic plate and a Kevlar cloth, glass cloth or other ground fabric or the same inorganic fluid material constituting the wave absorbing framework optionally containing a Kevlar fiber or glass fiber; said wave absorber may be formed to serve also as a building block.

13 Claims, 7 Drawing Sheets

ELECTROMAGNETIC WAVE ABSORBER

BACKGROUND OF THE INVENTION

This invention relates to an electromagnetic wave absorber, hereinafter to be called "wave absorber", more particularly to a wave absorber which absorbs waves, for example, coming to the wall surface of a multi-stored building without reflecting them thereby to prevent generation of ghost on the television receiver, or which is used as the interior wall of wave anechoic chambers to improve wave interception efficiency.

If large-scale constructions such as multi-stored buildings and warehouses are present in a propagation area of waves emitted, for example, from a television tower, television microwaves impinge upon the exterior wall of such buildings and reflected thereby. Accordingly, if a television wave is received near the large-scale building, ghost is generated on the screen of the television receiver due to the time difference between the wave coming directly from the television tower and the delayed wave coming after it is reflected by the wall surface of the building, which phenomenon has given rise to an environmental problem of wave interference.

In order to cope with such ghost generation, a countermeasure is taken in some large-scale buildings to apply a wave absorber, on the external wall surface of such buildings, which is adapted to absorb waves as much as possible without substantially reflecting them thereby. Conventional wave absorbers each consist of a ferrite tile directly bonded with an adhesive to a predetermined size of concrete plate or of a ferrite tile bonded to a concrete plate through mortar and a metal plate. Thus, if matching is achieved between the impedance of the wave absorber as viewed from the wave emitting direction and that of the free space when a television wave impinging on the wave absorber attached on the wall surface of the multi-storied building and the like, the television wave will not be reflected and the ghost phenomenon can be cleared.

In fact, however, it is extremely difficult to achieve matching between these impedance values in the conventional wave absorber, and the reflection attenuation achieved thereby is merely at the level of about 15 dB for the VHF range channels 1 to 3 and about 20 dB for the VHF range channels of 4 or more. Moreover, since the conventional wave absorber is of a multilayered structure comprising a ferrite tile, mortar, a metal plate and a concrete plate as described above, the total weight thereof will inevitably be increased, making it difficult to apply the wave absorber onto the wall surface of the building, disadvantageously. Further, it can be pointed out that the ferrite tiles constituting the wave absorber are liable to drop off due to the difference between the expansion coefficients of the respective materials, layer separation at the resin adhesive or cracking in the concrete wall to be caused by the swelling after water absorption. As a countermeasure for preventing such drop off of the tiles, it can be contemplated to reduce weight of the wave absorber. However, it is very difficult to achieve such weight reduction without lowering wave absorption characteristics and permanence thereof.

The present invention has been proposed in view of the above problems inherent in the conventional wave absorbers and for the purpose of overcoming them in a suitable manner, and it is an object of this invention to provide a wave absorber which not only has a high level of wave absorption and a relatively light weight but also can be manufactured easily.

SUMMARY OF THE INVENTION

The wave absorber according to this invention comprises an electromagnetic wave absorbing framework having a plurality cells arranged to define arbitrary shape of U-shaped hollow spaces adapted to the wavelength of the electromagnetic wave to be absorbed, which is prepared by introducing bubbles into an inorganic fluid material and solidifying the bubbled material, and an electromagnetic wave absorbing ferrite material applied at least on the walls of the cells defining said U-shaped hollow spaces.

The wave absorbing panel may have an electromagnetic wave transmitting plate having weathering resistance applied on the top surface thereof.

If a television wave, for example, of a VHF or UHF range impinges upon the thus constituted wave absorber, the impedance, as viewed from the wave emitting direction, in the wave absorber having an arrangement of lattice or honeycomb-structured, circular or other arbitrary shape of hollow spaces is relatively well matched with the impedance of the free space, whereby the wave absorber can effectively absorb the wave to assume substantially non-reflective posture. Incidentally, in the case where the electromagnetic wave transmitting plate is attached on the surface of the wave absorbing panel, weathering resistance of the exterior wall surface of the building can be improved, so that the functions as the wall material can sufficiently be imparted to the present wave absorber.

PREFERRED EMBODIMENTS OF THIS INVENTION

Next, the present wave absorber will be described by way of a preferred embodiment referring to the attached drawings.

Figure 1:
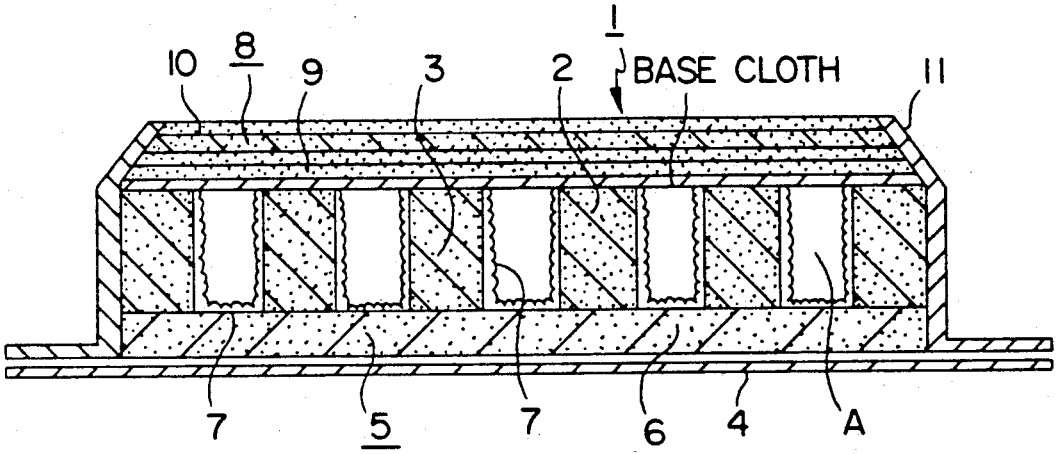
FIG. 1 shows a cross-sectional view of the wave absorber according to a first embodiment of this invention.
Figure 2:
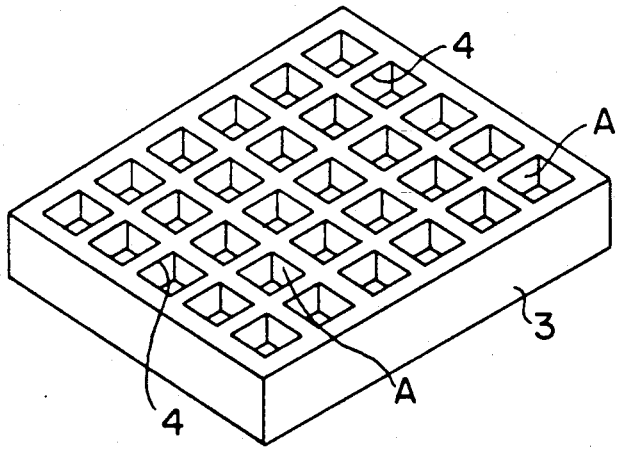
FIG. 2 shows a perspective view of a lattice-structured wave absorbing member.
Figure 6:
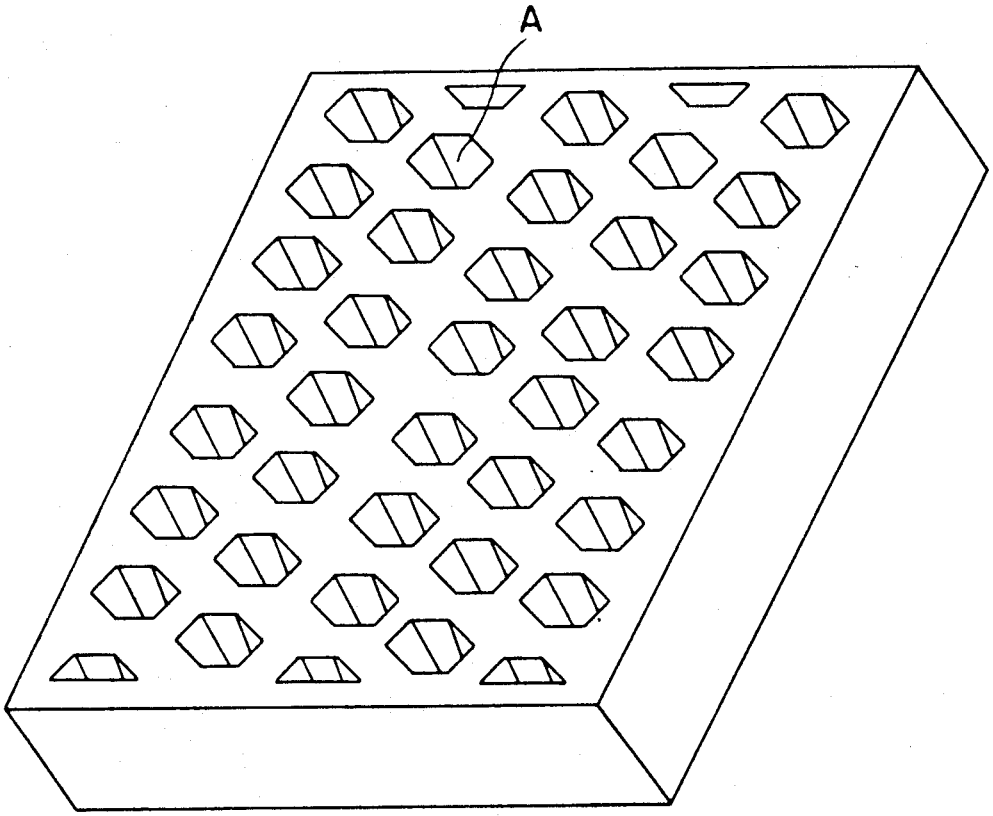
FIG. 6 shows a perspective view of a honeycomb-structured wave absorbing framework according to another embodiment.
Figure 7:
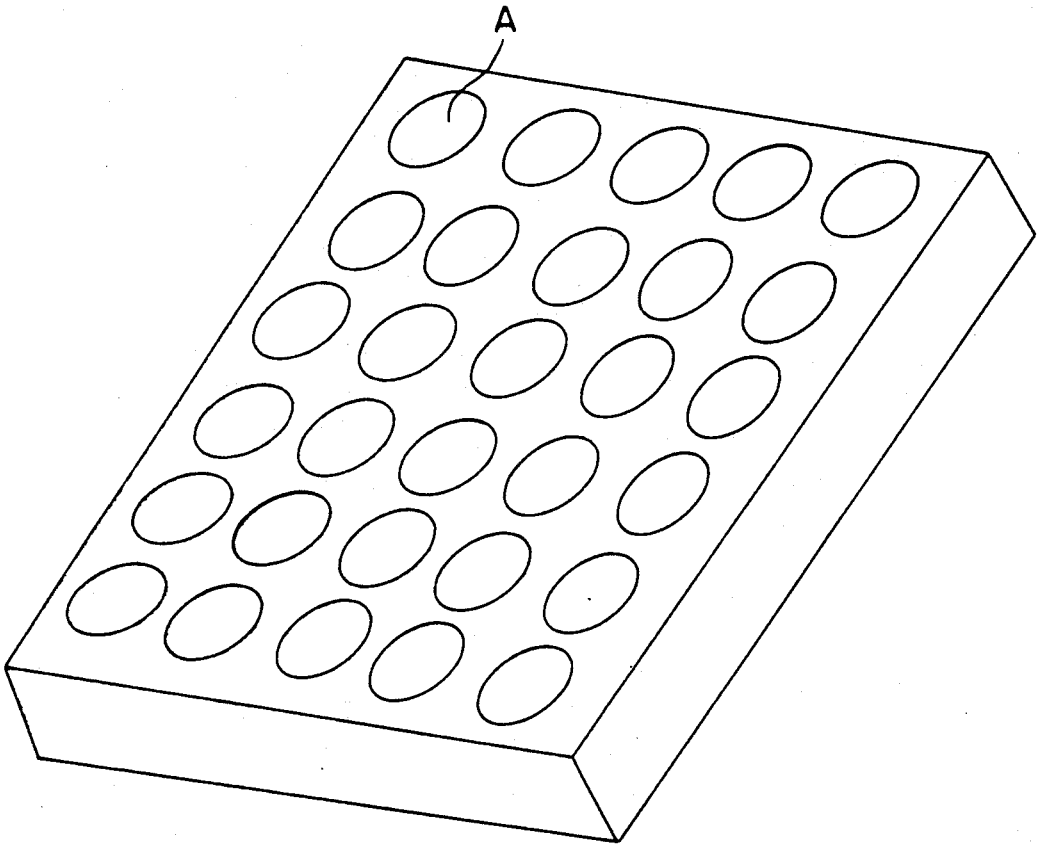
FIG. 7 shows a perspective view of a wave absorbing framework having ellipsoidal cavities according to another embodiment.

FIG. 1 shows a preferred embodiment of the wave absorber 1 according to this invention, which essentially comprises a framework 3 having U-shaped hollow spaces, made by solidifying an inorganic fluid material to which bubbles are introduced and an electromagnetic wave absorbing ferrite material 7 which is deposited to the cells defining said hollow spaces, said U-shaped hollow spaces having an arbitrary shape adapted to the wavelength of the electromagnetic wave to be absorbed. For example, bubbles are introduced into an inorganic material such as cement and ceramic and the bubbled inorganic material is solidified in a predetermined shape of mold to form a wave absorbing framework 3 in which square cells 4 each defining a hollow space A are arranged to form a lattice structure, as shown in FIG. 2. The hollow space A has arbitrary dimensions adapted to the wavelength of the electromagnetic wave to be absorbed. For example, the wave absorbring framework 3 is designed to have a thickness of 20.0 mm and an area of 1.0 $m^2$. Incidentally, the arrangement of the hollow spaces A may be other than the lattice structure, and honeycomb structure as shown in FIG. 6 or an arrangement of ellipsoidal hollow spaces as shown in FIG. 7 are possible.

Figure 3:
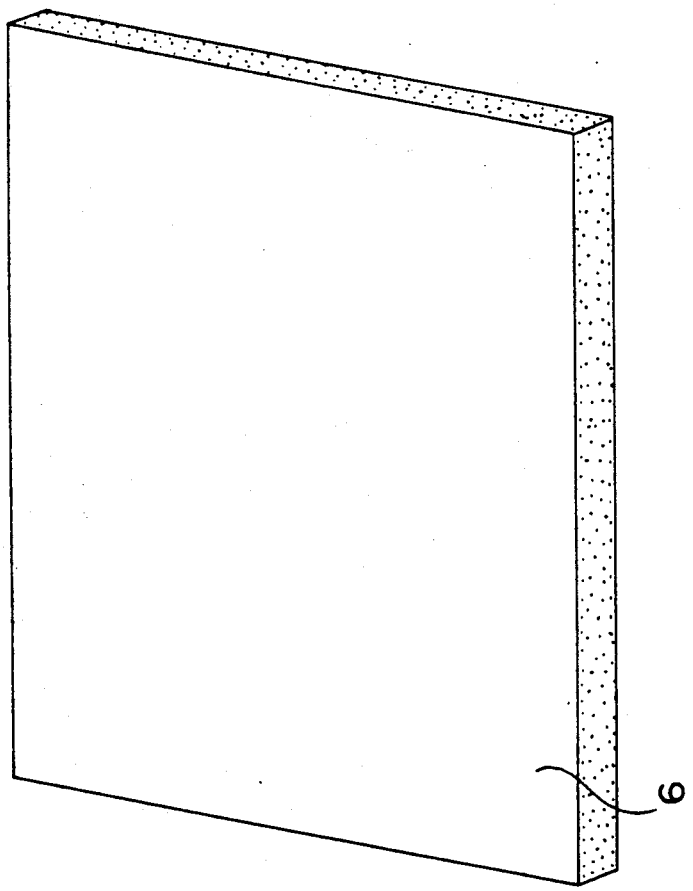
FIG. 3 shows, in perspective view, an electrically conductive filter member.

An electrically conductive filter member 6 having been integrally molded in a mold (not shown) is integrated with the thus obtained wave absorbing framework 3 to constitute an electrically conductive filter layer 5 of the wave absorber 1. Namely, as shown in FIG. 3, an inorganic material such as cement or ceramic, to which bubbles are introduced is molded into a rectangular electrically conductive filter member 6 having an arbitrary thickness and an area of 1.0 $m^2$, which is bonded to the bottom of the lattice-structured wave absorbing framework 3 to form an integral body.

The integral body thus obtained is coated with a wave absorbing ferrite ($Fe_3O_4$) layer 7 to form a lattice-structured wave absorbing main body 2. This coating process can be carried out by spraying a ferrite liquid containing a resin and particularly preferably a metal fiber to the integral body or the integral body is dipped in the ferrite liquid.

Figure 4:
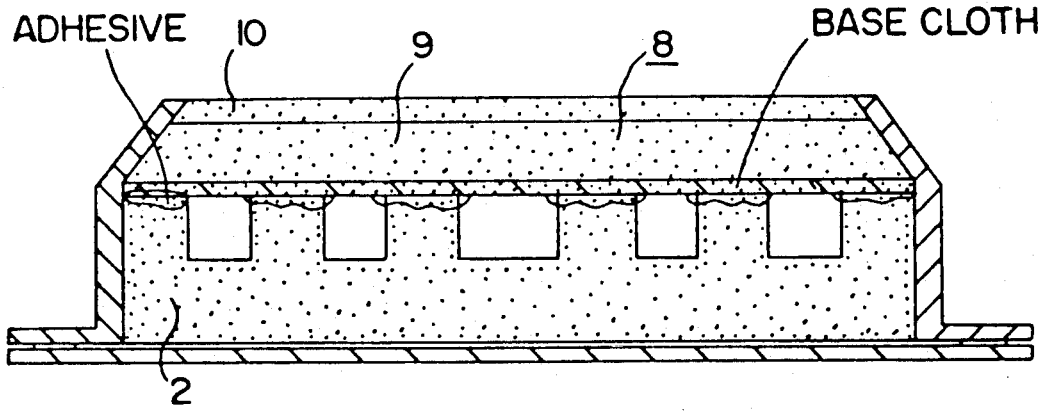
FIG. 4 shows, in cross section, a side view of electromagnatic wave transmitting panel.

It is preferred that the wave absorber 1 has an electromagnetic wave transmitting layer for protecting the wave absorber 1 from the outer air. Preferably used as such electromagnetic wave transmitting layer 8, is the one as shown in FIG. 4, which is formed by solidifying a bubbled inorganic fluid material such as cement or ceramic to form a rectangular plate 9, on the surface of which a fluoroplastic or silicone resin film 10 is formed by coating to the thickness of 10 mm.

Incidentally, as the electromagnetic wave transmitting panel 8, a ceramic panel reinforced with a ground fabric, for example, a Kevlar cloth comprising a polyamide resin, a glass cloth, etc. can be used; or otherwise said plate 8 may be of the bubble-containing inorganic material itself, prepared by introducing bubbles into an inorganic fluid material and solidifying the bubbled fluid material; or further may comprise a fabric web based on Kevlar fiber or glass fiber bonded on each side with a pair of plates made by solidifying the bubble-containing inorganic liquid material, or may be a plate member comprising said bubble-containing inorganic material into which a Kevlar fiber or glass fiber is introduced.

The thus formed electromagnetic wave transmitting panel 8 and the lattice-structured wave absorbing main body 2 are boned together with an adhesive, for example, with an epoxy adhesive, as shown in FIG. 1, and the resulting composite is fitted in a reinforcing metal frame 11 to complete a wave absorber 1.

Figure 5:
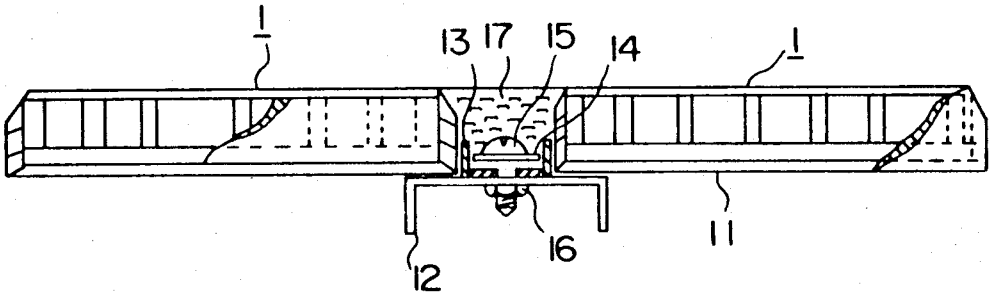
FIG. 5 shows a vertical cross-sectional view of the present wave absorber attached onto the wall surface of a building through a channel member.

The wave absorber 1 having the above constitution is installed, for example, as shown in FIG. 5. To describe in detail, rails 13 are applied with predetermined intervals or a multiplicity of channel members 12 exposed on the exterior wall surface of a large-scale building, such as multi-storied buildings, and the rails 13 are fixed on the channel members 12 by bolts 15 and nuts 16. The reinforcing metal frames 11 of the wave absorbers 1 are forcedly pressed into the spaces between the adjacent pairs of rails 13, whereby the wave absorbers 1 can be fixed on the exterior wall surface. It should be noted, however, theat the edge of the metal frame 11 is chamfered along the perimeter thereof with a predetermined width to make the wave absorbing efficiency in the wave absorbers 1 as high as possible, and the joint between wave absorbers 1 is sealed with a compound 17 comprising a mixture of 50% of a silicone (JIS A 5755) and 50% of a ferrite powder ($Fe_3O_4$) to prevent reflection of waves and intrusion of rainwater as much as possible.

As has been described above, when a television wave such as of VHF or UHF region impinges upon the wave absorber 1 attached go the exterior wall surface of a multi-storied building or large-scale warehouse, relatively high level of matching is achieved between the impedance as viewed from the wave emitting direction and that in the free space in the lattice-structured wave absorber 1 having hollow spaces A. Accordingly, the wave absorber 1 absorbs the television wave at high efficiency to assume substantially nonreflective posture, and the ghost phenomenon can thus be prevented effectively.

Figure 8:
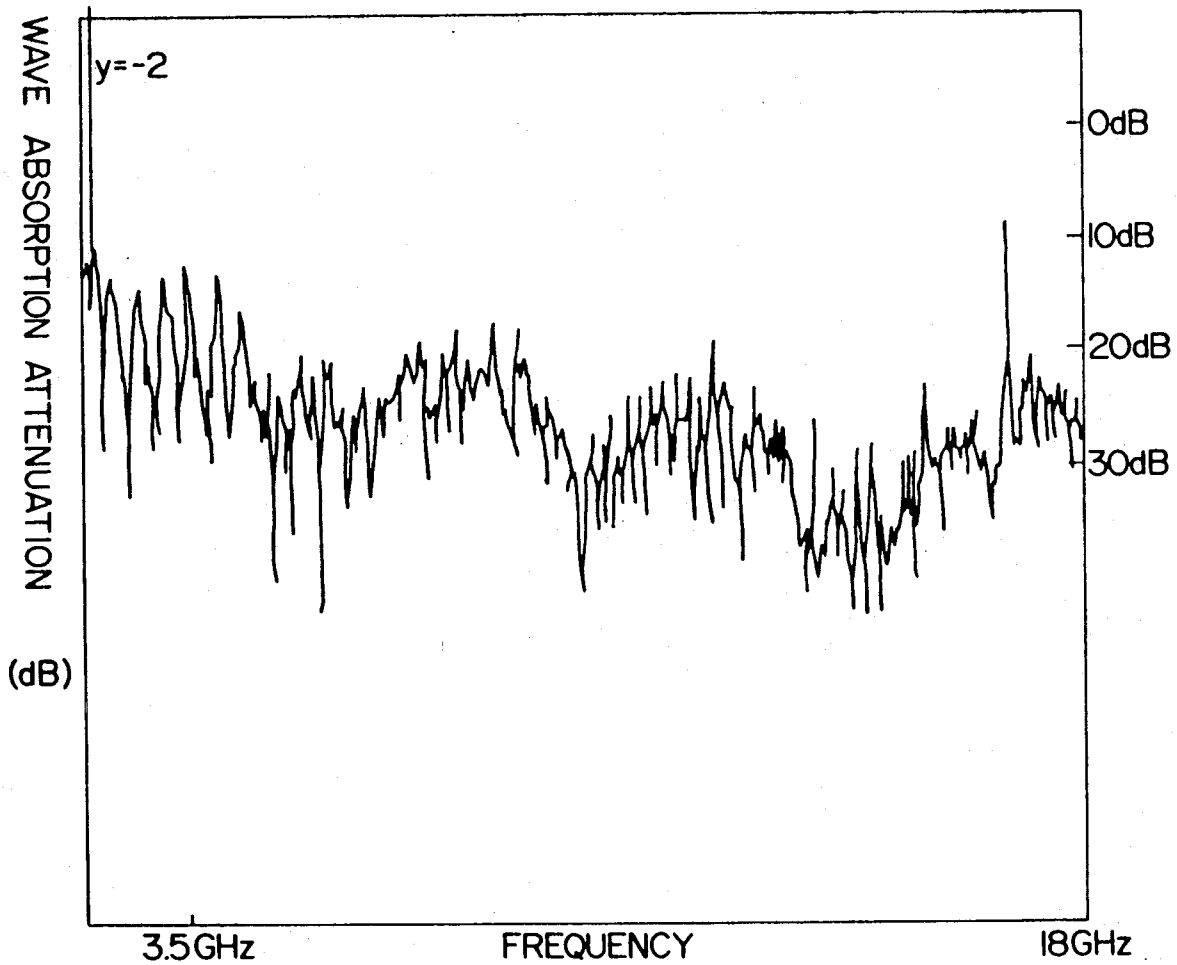
FIG. 8 is a wave profile showing characteristic data of the wave absorber according to the first embodiment of this invention.

When wave absorption characteristics of the wave absorber 1 were determined by the testers manufactured by ADVANTEST CORPORATION (Spectrum Analyzer TR 4136, Synthesized Sweeper TR 4515, Sweep Adapter TR 13211 and X-Y Plotter TR 3835), it was found that a wave reflection attenuation of about 20 to 30 dB at a frequency of 3.5 to 18 GHz can be achieved as shown in FIG. 8. The test results show that the present wave absorber has sufficient wave absorption characteristics to be used as a wave absorber provided on the exterior wall surface of buildings for preventing ghost phenomenon or on the interior wall surface of wave anechoic chambers, or as the coating on the fuselage of military stealth aircraft which absorbs radar waves to disturb searching operations by the enemy.

Incidentally, depending on the frequency of the wave to be absorbed and the environmental conditions, the wave absorber 1 may have a separately molded arbitrary shape of wave absorbers in the hollow spaces A defined by the plurality of cells 4. Alternatively, a curled metal short fiber such as of stainless steel may be incorporated into the bubbled concrete constituting the lattice-structured wave absorbing framework 3 and the electrically conductive filter member 6, so that the mechanical strength of these members 3, 6 may greatly be improved.

What is claimed is:

1. A wave absorber comprising an electromagnetic wave absorbing framework having a plurality of cells arranged to define an arbitrary shape of U-shaped hollow spaces adapted to the wavelength of the electromagnetic wave to be absorbed and an electromagnetic wave absorbing ferrite material applied at least on the walls on the cells defining said U-shaped hollow spaces wherein:

said electromagnetic wave absorbing framework is made of a solid, bubbled inorganic material;

an electromagnetic wave transmitting panel made from solid, bubbled inorganic material is provided on said electromagnetic wave absorbing framework;

a weathering resistance coating is formed on the surface of said electromagnetic wave transmitting panel; and a reinforcing metal frame is provided surrounding said electromagnetic wave absorbing framework and said electromagnetic wave transmitting panel.

2. A wave absorber system comprising a plurality of electromagnetic wave absorbing frameworks, each of said frameworks having a plurality of cells arranged to define an arbitrary shape of U-shaped hollow spaces adapted to the wavelength of the electromagnetic wave to be absorbed and an electromagnetic wave absorbing ferrite material which is mounted on said plurality of cells, wherein:

each of said electromagnetic wave absorbing frameworks is made of a solid, bubbled inorganic material;

an electromagnetic wave transmitting panel formed of solid, bubbled inorganic material is provided on each of said plurality of framework;

a weathering resistance coating is formed on the surface of each of said plurality of said electromagnetic wave transmitting panels;

rails are applied at predetermined intervals on an exterior surface of a structure;

a reinforcing metal frame is provided surrounding said electromagnetic wave absorbing framework and said electromagnetic wave transmitting panel; and each of said electromagnetic wave absorbing frameworks together with its electromagnetic wave transmitting panel are mounted to said structure by forcibly pressing said reinforcing frame into the space between adjacent pairs of said rails.

3. The wave absorber according to claim 1, wherein the solid, bubbled inorganic material is cement.

4. The wave absorber according to claim 1, wherein the solid, bubbled inorganic material is ceramic.

5. The wave absorber according to any one of claims 3, 4 and 1 wherein the cells are arranged to form a lattice structure.

6. The wave absorber according to any one of claims 3, 4 and 1 wherein the cells are arranged to form a honeycomb structure.

7. The wave absorber according to any one of claims 3, 4 and 1 wherein the cells have an arbitrary circular shape including ellipsoid.

8. The wave absorber according to claim 1, wherein the electromagnetic wave transmitting panel is a reinforced ceramic panel comprising a ceramic plate with a Kevlar cloth, glass cloth or other ground fabric bonded thereto.

9. The wave absorber according to claim 1, wherein the electromagnetic wave transmitting panel comprises an inorganic fluid material having been solidified after bubbles are introduced therein.

10. The wave absorber according to claim 1, wherein the electromagnetic wave transmitting panel comprising an inorganic fluid material having been solidified after bubbles are introduced therein has a coating film of a fluoroplastic or silicone resin.

11. The wave absorber according to claim 1, wherein the electromagnetic wave transmitting panel comprises a pair of ceramic plates made of an inorganic fluid material having been solidified after bubbles are introduced therein which are bonded together with fabric of Kevlar fiber or glass fiber interposed therebetween.

12. The wave absorber according to any one of claims 9 to 11, wherein the electromagnetic wave transmitting panel comprising a bubble-containing inorganic material further contains a Kevlar fiber or glass fiber.

13. The wave absorber according to any one of claims 3-11 and 1, wherein the wave absorber is formed to serve also as a building block.

* * * * *